US007322837B2

(12) United States Patent
Mueller

(10) Patent No.: US 7,322,837 B2
(45) Date of Patent: Jan. 29, 2008

(54) PLUG CONNECTOR MODULES OF A PLUG CONNECTOR FOR SIMULTANEOUSLY CONNECTING A PLURALITY OF ELECTRICAL CONTACTS

(75) Inventor: Walter Mueller, Oehringen-Ohrnberg (DE)

(73) Assignee: Atmel Germany GmbH, Heilbronn (DE)

( * ) Notice: Subject to any disclaimer, the term of this patent is extended or adjusted under 35 U.S.C. 154(b) by 0 days.

(21) Appl. No.: 11/231,890

(22) Filed: Sep. 22, 2005

(65) Prior Publication Data

US 2006/0094274 A1 May 4, 2006

(30) Foreign Application Priority Data

Oct. 29, 2004 (DE) ..... 10 2004 053 516

(51) Int. Cl.
*H01R 13/62* (2006.01)

(52) U.S. Cl. ..... 439/157

(58) Field of Classification Search ..... 439/157, 439/372, 310, 152, 153; 174/135, 136, 152 G, 174/153 G, 65 G
See application file for complete search history.

(56) References Cited

U.S. PATENT DOCUMENTS 4,213,666 A 7/1980 Braginetz et al.
4,614,393 A 9/1986 Laskaris
5,924,880 A 7/1999 Watanabe et al.
6,293,813 B1 9/2001 Johnston et al.
6,462,532 B1 * 10/2002 Smith ..... 324/158.1
6,822,436 B2 * 11/2004 Frame ..... 324/158.1

FOREIGN PATENT DOCUMENTS

DE 195 08 218 A1 9/1996
DE 102 04 180 C1 8/2003
EP 0 501 502 A2 9/1992
EP 0 843 386 A1 5/1998

* cited by examiner

*Primary Examiner*—Alexander Gilman
(74) *Attorney, Agent, or Firm*—Geissler, Olds & Lowe

(57) ABSTRACT

A first plug connector module of a plug connector for substantially simultaneously connecting a plurality of electrical contacts between a test signal generator and a measurement card of a handling fixture which delivers elements to be tested to the measurement card. The plug connector module is characterized in that it has an element that is rotatable about an axis of rotation and has, coupled to the rotatable element, a receptacle that accommodates a mating part of a second plug connector module and that is displaced in translation upon rotation of the element relative to the first plug connector module, wherein the translational motion occurs perpendicular to the axis of rotation.

25 Claims, 4 Drawing Sheets

PLUG CONNECTOR MODULES OF A PLUG CONNECTOR FOR SIMULTANEOUSLY CONNECTING A PLURALITY OF ELECTRICAL CONTACTS

This nonprovisional application claims priority under 35 U.S.C. § 119(a) on German Patent Application No. DE 102004053516.7, which was filed in Germany on Oct. 29, 2004, and which is herein incorporated by reference.

BACKGROUND OF THE INVENTION

1. Field of the Invention

The present invention relates to a first plug connector module of a plug connector for simultaneously connecting a plurality of electrical contacts between a test signal generator and a measurement card of a handling fixture, which delivers elements to be tested to the measurement card.

The invention further concerns a second plug connector module of such a plug connector.

2. Description of the Background Art

Test signal generators, measurement cards, and handling fixtures are used in the testing of wafers and integrated circuits. The test signal generators, which are frequently also referred to as "test heads," are capable of providing a variety of different signals for testing. The test signal generator is connected to the measurement card, which in turn is periodically loaded by the handling device with components to be tested, and which may also provide signals that are exchanged between the test device and the elements to be tested. The components to be tested are frequently referred to as "devices under test," which is the source of the name "DUT board" for the measurement card. Handling fixtures are also frequently referred to as "handlers/wafer probers."

A typical test duration for a complete series or batch of components is on the order of a few hours to a few days. The testing of a batch is generally followed by the testing of a different batch, which requires different signal processing and thus a different, new measurement card. To remove the old measurement card from the system and integrate the new measurement card, the connection between the test signal generator and the measurement cards must be opened and closed.

In this context, a conventional method called direct docking is known for connecting the test signal generator to the measurement card on the handling fixture. This is understood to mean a direct connection of the "test head" with the aid of a manipulator on the "handler." This solution is very expensive (typical costs of 80,000 Euros per docking system) and requires a great amount of space on account of the combination of the test signal generator, manipulator and handling fixture. Moreover, the contacting is very sensitive to mechanical shock to the handling fixture on account of the direct connection.

Another conventional method for opening and closing the plug connection provides a cable connection with the aforementioned plug connector modules in place of the direct docking. When the connection is being made, one of the plug connector modules is guided by guide rails that are fastened to the other plug connector module. Due to the great complexity of the test signal generator, several hundred contact pairs must generally be connected or disconnected with such plug connectors. The large number of contacts results in a high packing density of the contact arrangement in the plug connector modules, and also produces a high total resistance, resulting from the sum of the resistances of all individual contact pairs, which must be overcome when connecting the plug connector modules. A typical value for the total resistance to be overcome is 500 Newtons for a plug connector with several hundred contact pairs. Such forces can be manually applied only with difficulty, and can also result in damage to individual contacts in the presence of even small inaccuracies in guidance. In order to avoid damage to the contacts, all contacts must make contact as close to simultaneously as possible, which requires precise guidance. The high insertion and extraction forces make manual connection and disconnection more difficult. Replacement of defective contacts, which can be damaged because of the high forces in the event of insufficiently precise guidance, is time-consuming and expensive, especially if the entire test system is out of operation during the repair.

SUMMARY OF THE INVENTION

It is therefore an object of the present invention to provide plug connector modules that reduce the risk of damage to contacts. Moreover, the plug connector modules should be manually connected and disconnected in a manner that is rapid as well as uncomplicated and reliable to handle. It goes without saying that the solution should also be economical.

This object is attained in a first plug connector module of the aforementioned type in that the first plug connector module has an element that is rotatable about an axis of rotation and has, coupled to the rotatable element, a receptacle that accommodates a mating part of a second plug connector module and that is displaced in translation upon rotation of the element relative to the first plug connector module, wherein the translational motion occurs perpendicular to the axis of rotation.

The object is further attained in a second plug connector module of the aforementioned type in that the second plug connector module has a mating part that is designed to be accommodated in a receptacle that is coupled to an element of a first plug connector module, the element being rotatable about an axis of rotation, and in that the mating part undergoes a translational motion relative to the first plug connector module upon rotation of the element, with the translational motion occurring perpendicular to the axis of rotation.

The translational motion in this context occurs in one direction for connection and in the other direction for disconnection. The production of the translational motion from a rotation with an axis of rotation perpendicular to the translational motion makes it possible to convert a small translational motion on the order of a few millimeters into a rotary motion over a relatively large angular range. With the aid of a lever arm, the closing and opening of the connection can then be accomplished manually and with sensitivity despite the resistance, which in some circumstances can be high. In this way, the advantages of manual handling can be maintained with simple designs and a reduced risk of damaging contacts. In other words, the invention makes it possible to dispense with the expensive and shock-sensitive manipulator solution without the risk of damage to contacts that was previously associated with the use of cable connections that are manually connected and disconnected. Overall, there results a more cost-effective design of a measurement cell, permitting rapid assembly of the measurement setup, and hence rapid contacting of the test signal generator and measurement card on the handling fixture.

Within the scope of embodiments of the first plug connector module, the receptacle can be integrated into the rotatable element and for the rotatable element to have a path along which the mating part is guided that is eccentric to a center of rotation of the rotatable element.

As a result of such an integration, a very compact and stable solution is provided. The high contact forces are overcome by an eccentric curve that rises slowly with rotation.

In another embodiment, the path can also have a section that is spiral-shaped.

In conjunction with the other features, a spiral-shaped section produces a continuous translational motion without irregularities from a continuous rotary motion. The force required to overcome the resistances during opening and closing can thus be adjusted in a particularly sensitive manner.

The path can be defined by a gate arranged at least partially inside the volume of the rotatable element. Alternatively, it is preferred for the path to be defined by a guide rail that runs on the rotatable element.

Both alternatives represent compact and stable solutions, with the gate solution being flatter while the guide rail solution may be easier to manufacture.

The path can also have a metallic surface, which results in an advantageously high wear resistance.

This advantage can be accentuated still further in that the path has a titanium nitride surface, since titanium nitride is known to be especially wear-resistant.

Further, the rotatable element can be made of metal.

Such a design is distinguished by high stiffness and strength.

Another embodiment includes a lever for manually rotating the rotatable element, the lever being attached to the element in a rotationally fixed manner.

The rotationally fixed lever provides for a conversion, predetermined by the lever length, by which the manual actuation of the rotatable element is transformed into a translational motion of the contacts.

The path can have, at a predefined relative position of the first plug connector module and of the second plug connector module, a ridge that is crossed by the mating part at a specific angle of rotation of the lever, thereby producing a jerk in the motion of the mating part.

The jerk provides tactile feedback upon reaching a predefined lever position, and thus a predefined position of the contacts. Due to the tactile indication, manual operation of the device is eased and, moreover, all elements involved are protected in actual operation, since it is not necessary to actuate the device all the way until each of the design required stops are reached.

With regard to embodiments of the second plug connector module, it is preferred for the mating part to have a bearing that permits the mating part to roll along the path.

Rolling of the mating part along the path further reduces wear of the path and of the mating part.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
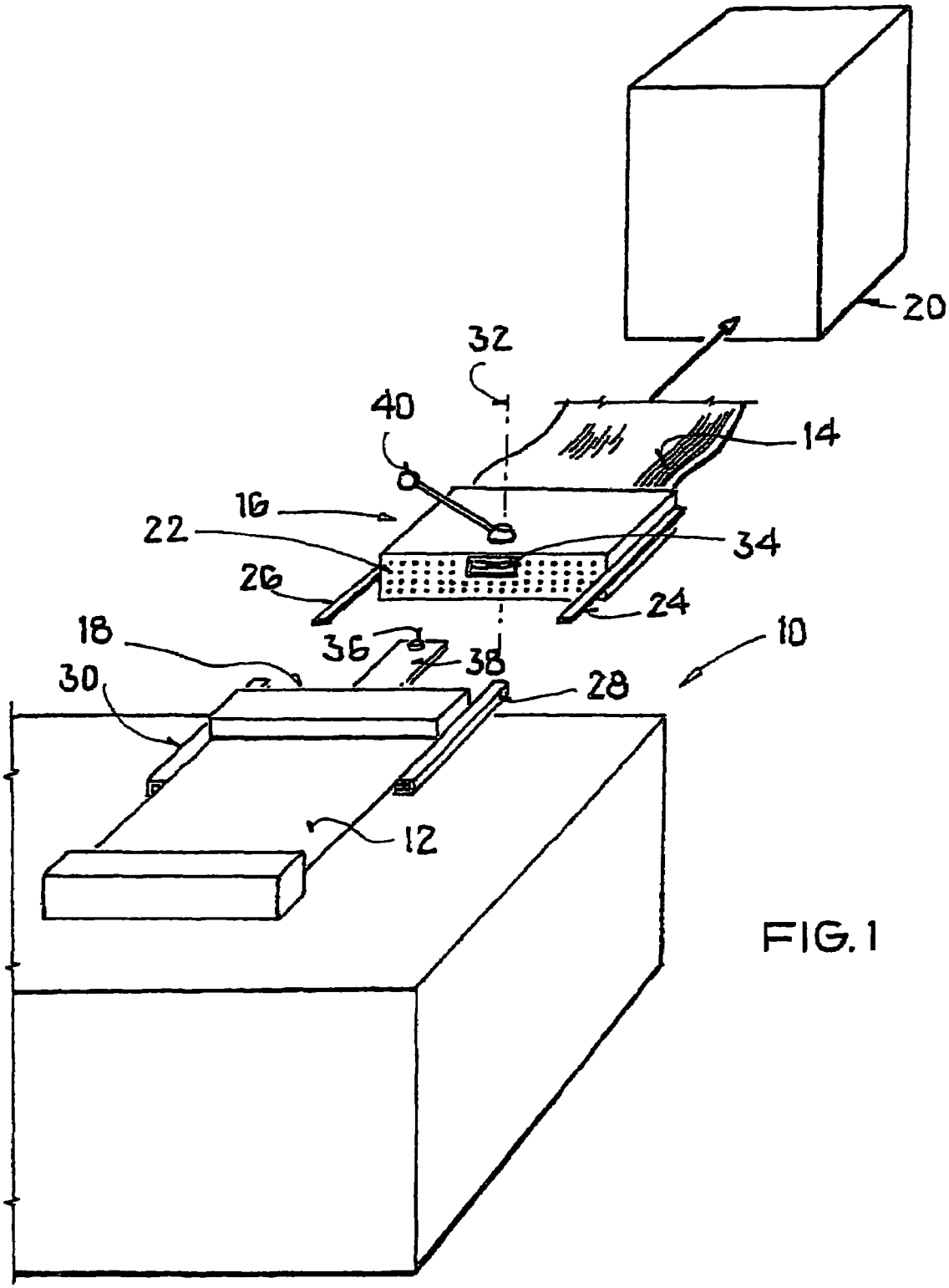
FIG. 1 illustrates an overall view of a measurement setup of a test signal generator, handling fixture with measurement card, and plug connector modules, according to an embodiment of the present invention.

FIG. 1 shows a handling fixture 10 on which is mounted a measurement card 12. The handling fixture delivers elements to be tested, for example integrated circuits or wafers of semiconductor material, to the measurement card 12 in such a manner that the measurement card 12 electrically contacts the elements to be tested. A test signal generator 20 exchanges electrical signals with the measurement card 12 through a cable 14 and through plug connector modules 16 and 18. In this regard, the test signal generator 20 is capable of providing a wide spectrum of analog and digital signals with various waveforms and frequencies in various voltage ranges. The measurement card 12 has circuitry that conditions the signals from the test signal generator 20 for the specific circuit or wafer of semiconductor material to be tested. In order to make possible individual signal conditioning for various types of integrated circuits, the measurement card 12 is replaceable.

To replace the measurement card 12, the signal connection to the test signal generator 20 must also be opened. This purpose is served by the plug connector modules 16 and 18, with a first plug connector module 16 being connected to the cable 14 and a second plug connector module 18 being connected to the measurement card 12. The first plug connector module 16 has a plurality of electrical contacts 22 which are complementary to a plurality of contacts of the second plug connector module 18. As a result of the high tester complexity, approximately 500 plug contacts may in some cases be necessary at the interface to the measurement card. In order to avoid damage to the electrical contacts 22 in the first plug connector module 16 and also in the second plug connector module 18, all contact pairs must make contact as close to simultaneously as possible during mating.

Due to the high packing density, this requires precise guidance during connection of the plug connector modules 16 and 18. In order to ensure this, the first plug connector module 16 has guide rails 24 and 26 which are guided in receiving rails 28 and 30 of the measurement card 12 when the plug connector modules 16 and 18 are mated. Because of the high insertion and extraction forces of, e.g., approximately 500 N for approximately 500 contact pairs, reliable mating of the plug connector modules 16 and 18 is difficult without aids.

To overcome the high insertion and extraction forces in a sensitive way, the first plug connector module 16 has an element 34 that is rotatable about an axis of rotation 32 and has, coupled to the rotatable element, a receptacle that accommodates a mating part 36 that is rigidly connected through a draw-in plate 38 to the second plug connector module 18. The receptacle is implemented, for example, as a gate that runs eccentrically about a center of rotation of the rotatable element 34 and that guides the mating part 36. Such a gate is described in greater detail below with reference to FIGS. 2 and 3. In this regard, the guidance is accomplished such that upon rotation of the element 34, the mating part 36 is displaced in translation relative to the first plug connector module 16. During the process, the displacement occurs perpendicular to the axis of rotation 32, in the direction of insertion or extraction of the first plug connector module 16 relative to the second plug connector module 18. The rotatable element 34 is moved manually by a lever 40 that is rotationally fixed to the element 34.

Figure 2:
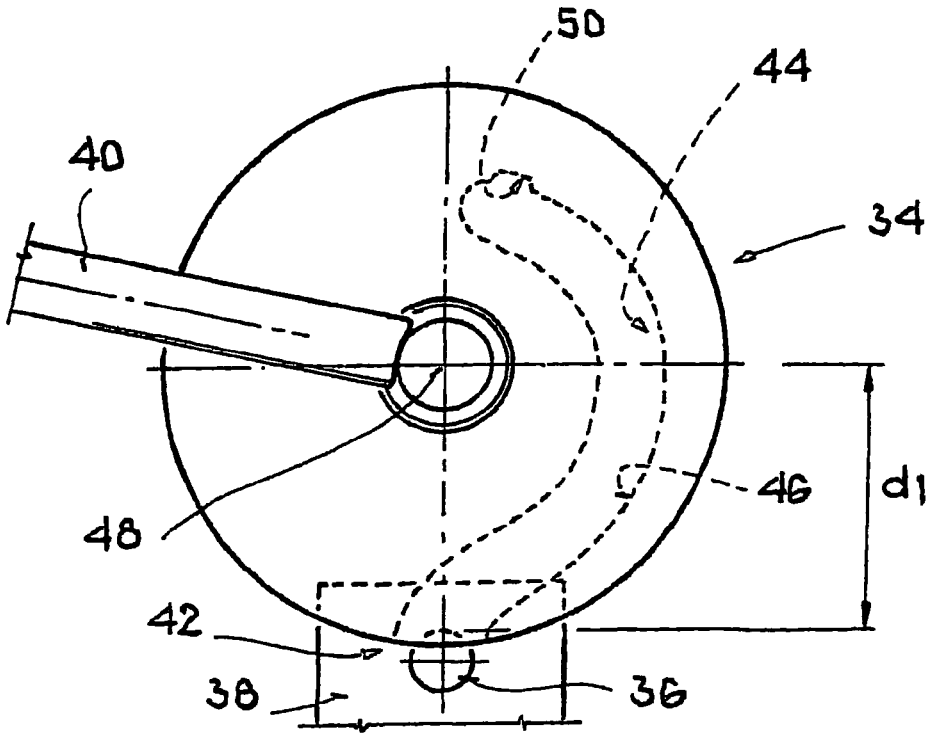
FIG. 2 is a top view of the rotatable element in the process of accommodating the mating part in a first angular position.
Figure 3:
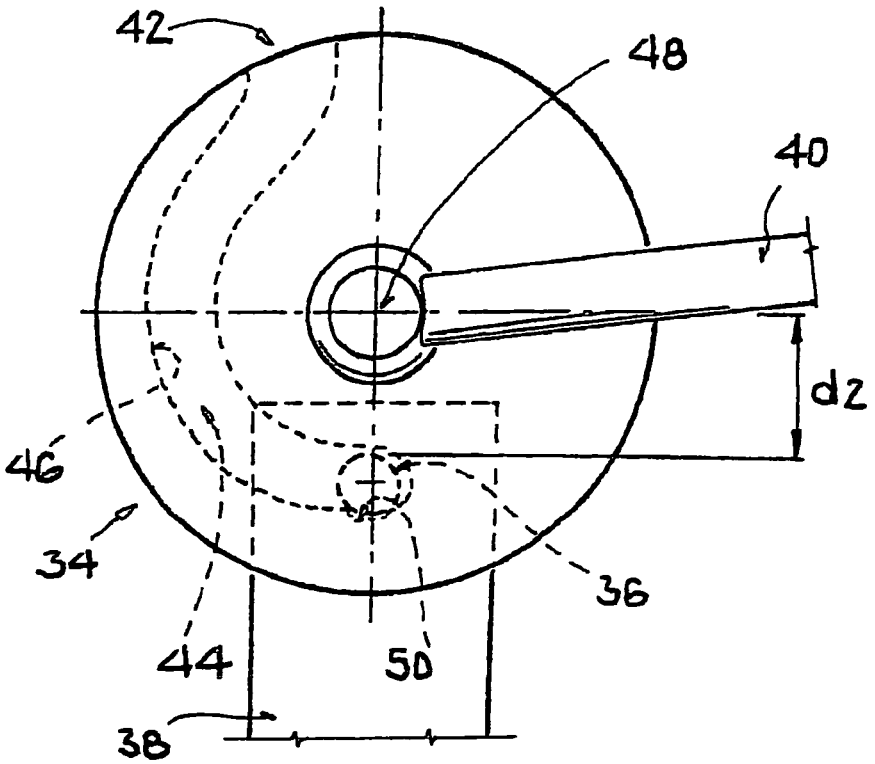
FIG. 3 is a top view of the rotatable element with the accommodated mating part in a second angular position.

FIG. 2 shows a top view of the rotatable element 34 in a first angular position. In order to illustrate the function, FIG. 2 and also FIG. 3 show only the elements which act together to create the relative translational motion, namely a section of the lever 40 and the mating part 36. The first angular position is distinguished in that an opening 42 of a gate 44 that is milled as a recess in the rotatable element 34 faces toward the second plug connector module 18 from FIG. 1 and can thus accommodate the mating part 36. The gate 44 thus forms an embodiment of the receptacle mentioned in connection with FIG. 1. When the element 34 is rotated, a path 46 guides the mating part 36 steadily closer to a center of rotation 48. To this end, the gate 44, and thus with it the path 46, runs eccentrically about the center of rotation 48. The eccentricity is produced by a course of the gate 44 with the path 46 that is spiral-shaped, at least in sections. As can be seen from FIG. 2, a distance d_1 has its maximum at the first angular position.

FIG. 3 shows the rotatable element 34 after a rotation of the lever 40 into a second angular position. The second angular position shows that the mating part 36 has been guided along the rotating path 46 closer to the center of rotation 48, so that the distance d_1 from FIG. 2 has decreased to a smaller value d_2 in FIG. 3. As a result of the translational motion of the mating part 36 associated with the reduction in the distance, the plug connector modules 16 and 18 from FIG. 1 are drawn together so that the angular position from FIG. 3 represents the mated condition of the plug connector of the plug connector modules 16 and 18, and the angular position from FIG. 2 represents the released condition.

For a long service life, the rotatable element 34 is preferably made of metal. At least the path 46 should have a metallic surface, where a hardened metallic surface such as a titanium nitride surface further increases wear resistance. Within the scope of one embodiment, the path 46 of the gate 44 has a ridge 50 that is crossed by the mating part 36 when the second angular position from FIG. 3 is reached. As a result, the resistive forces perceptible at the lever 40 briefly change, so that passing the ridge 50 results in a tactile indication of achieving or leaving the second angular position.

Figure 4:
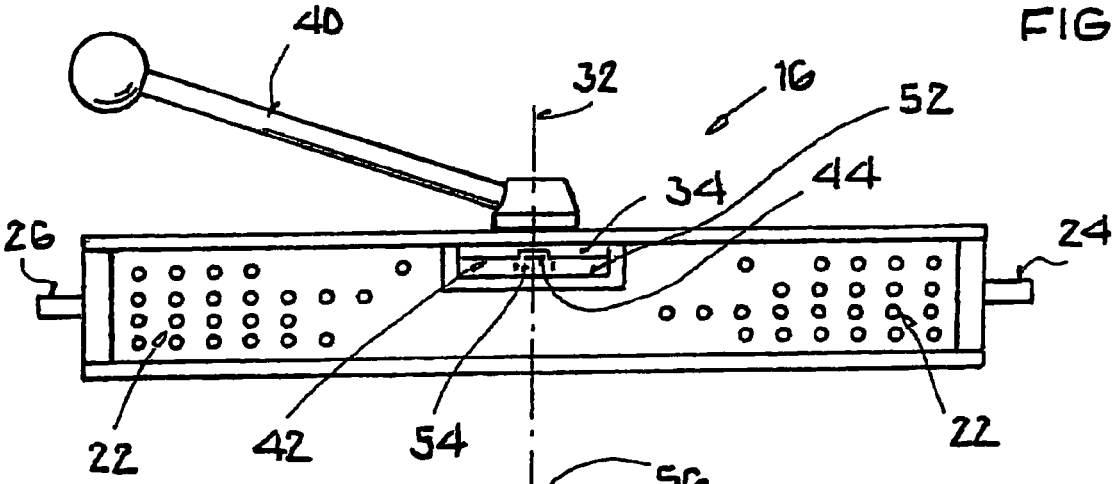
FIG. 4 is a front view of the first plug connector module.

FIG. 4 shows a front view of the first plug connector module 16 with an embodiment of a guide for the relative motion of the plug connector modules 16 and 18 during connection or disconnection of the plug connector. Here, as in the other figures as well, like reference numbers indicate like elements. Elements already explained in conjunction with FIGS. 1 through 3 thus are not explained separately again in conjunction with FIGS. 4 and 5.

Figure 5:
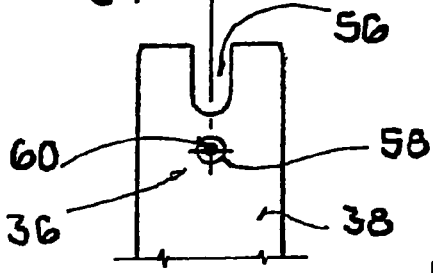
FIG. 5 illustrates an embodiment of the mating part of the second plug connector module.

The essential elements of FIG. 4 are a guide surface 52 and the shaft stub 54, which act together as additional guide elements with the draw-in plate 38, which was already shown in FIG. 2. A draw-in plate 38 of corresponding design is shown in FIG. 5. The draw-in plate 38 is distinguished by a slot 56 whose inside dimensions are precisely matched to the outside diameter of the shaft stub 54. The first plug connector module 16 is thus drawn into the second plug connector module 18 in the following manner overall: first, the guide rails 24, 26 of the first plug connector module 16 are guided into the receiving rails 28, 30 of the second plug connector module 18 and are pushed forward until plug contacts, which are arranged in the first plug connector module 16, for example, are precentered in jack contacts, which are arranged in the second plug connector module 18 as complementary contacts.

A forked guide of the draw-in plate 38, shown in FIG. 5, then encloses the shaft stub 54, and the mating part 36 is inserted in the opening 42 of the rotatable element 34. The high contact forces in closing the plug connector of the plug connector modules 16 and 18 are overcome through a slowly rising eccentric curve and the lever 40 by rotating the element 34. In this process, a certain amount of fine guidance of the relative motion between the plug connector modules 16 and 18 takes place as the contacts are drawn together (or pushed apart) by the fork-shaped slot 56 in the draw-in plate 38 and the shaft stub 54 and by the sliding of the draw-in plate 38 over the surface 52.

The mating part 36 can have a bearing, which in the simplest case is implemented by a sleeve 58, which is rotatably supported on a draw-in pin 60 that is rigidly connected to the draw-in plate 38.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

Figures 6, 7:
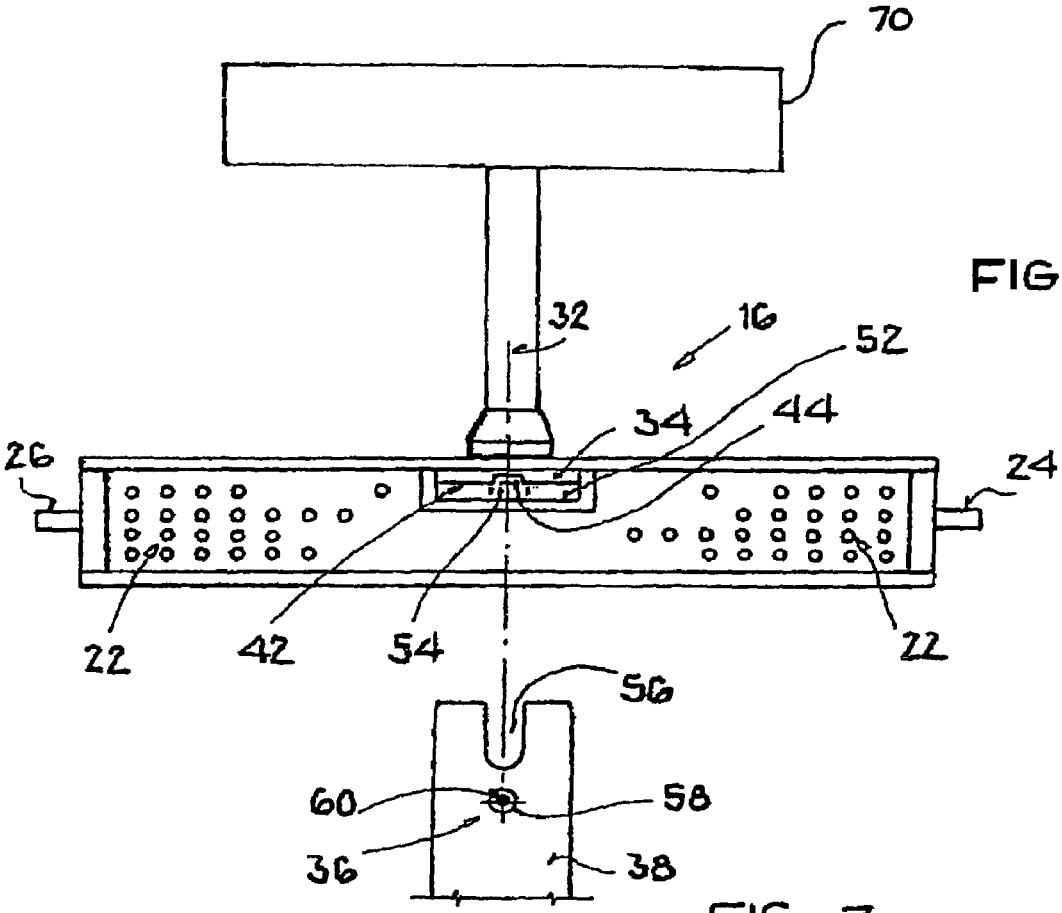
FIG. 6 is a front view of an embodiment of the first plug connector module.
FIG. 7 illustrates an embodiment of the mating part of the second plug connector module.

In another embodiment of the invention, as exemplarily illustrated in FIGS. 6 and 7, an electric motor 70 may be used to rotate the securing element.

What is claimed is:

1. A first plug connector module of a plug connector for substantially simultaneously connecting a plurality of electrical contacts between a test signal generator and a measurement card of a handling fixture, which delivers elements to be tested to the measurement card, the first plug connector module comprising:

a rotatable element that is rotatable about an axis of rotation, wherein rotation is applied using a lever coupled to the rotatable element at its center of rotation;

a receptacle that is coupled to the rotatable element, the receptacle accommodating a mating part of a second plug connector module, the mating part being displaced in a translation motion upon rotation of the rotatable element relative to the first plug connector module, wherein the translational motion occurs substantially perpendicular to the axis of rotation; and a guide surface that guides a draw-in plate of the second plug connector module to a shaft stub of the first plug connector module, wherein the draw-in plate of the second plug connector module has a slot formed therein for engaging the shaft stub of the first plug connector module to facilitate connection of the first plug connector module to the second plug connector module.

2. The first plug connector module according to claim 1, wherein the receptacle is integrated into the rotatable element, and wherein the rotatable element has a path, along which the mating part is guided, eccentric to a center of rotation of the rotatable element.

3. The first plug connector module according to claim 2, wherein the path has a section that is spiral-shaped.

4. The first plug connector module according to claim 2, wherein the path is defined by a gate arranged at least partially inside a volume formed by the rotatable element.

5. The first plug connector module according to claim 4, wherein the path has a metallic surface.

6. The first plug connector module according to claim 5, wherein the path has a titanium nitride surface.

7. The first plug connector module according to claim 1, wherein the rotatable element is made of metal.

8. The first plug connector module according to claim 1, further comprising a lever for manually rotating the rotatable element, the lever being attached to the rotatable element in a rotationally fixed manner.

9. The first plug connector module according to claim 8, wherein the path has, at a predefined relative position between the first plug connector module and the second plug connector module, a ridge that is crossed by the mating part at a specific angle of rotation of the lever, thereby producing a jerk in the motion of the mating part.

10. A second plug connector module of a plug connector for connecting a plurality of electrical contacts between a test signal generator and a measurement card of a handling fixture, which delivers elements to be tested to the measurement card, the second plug connector module comprising:

a mating part that is formed so that the mating part is accommodated in a receptacle that is coupled to an element of a first plug connector module, the element being rotatable about an axis of rotation, wherein rotation is applied using a lever coupled to the element at its center of rotation;

wherein the mating part undergoes a translational motion relative to the first plug connector module upon rotation of the element, and wherein the translational motion occurs substantially perpendicular to the axis of rotation; and a draw-in plate that is formed so that the draw-in plate is guided by a guide surface of the first plug connector module to a shaft stub of the first plug connector module, wherein the draw-in plate has a slot formed therein for engaging the shaft stub of the first plug connector module to facilitate connection of the first plug connector module to the second plug connector module.

11. A second plug connector module according to claim 10, wherein the mating part has a bearing that permits the mating part to follow along a path provided in the first plug connector module.

12. An apparatus for testing components, the apparatus comprising:

a test signal generator for providing test signals, the test signals being utilized to test the components;

a measurement card, the measurement card being electrically connected to the components that are to be tested;

a first plug module and a second plug module being adapted to connect and disconnect with one another and for electrically connecting the test signal generator with the measurement card in a connected state; and a securing element that rotates about a rotation axis and that facilitates connection and disconnection between the first plug module and the second plug module upon rotation of the securing element, wherein rotation is applied using a lever coupled to the securing element at its center of rotation, the securing element having a curvilinear groove formed therein that is in a plane that is substantially perpendicular to the rotation axis, the curvilinear groove engaging with a mating part that is fixedly connected to the second plug module, wherein the first plug module has a guide surface that guides a draw-in plate of the second plug module to a shaft stub of the first plug module, wherein the draw-in plate of the second plug module has a slot formed therein for engaging the shaft stub of the first plug module to facilitate connection of the first plug module to the second plug module.

13. The apparatus according to claim 12, wherein the measurement card is replaceable.

14. The apparatus according to claim 12, wherein the measurement card is replaceably mounted on a handling fixture, the handling fixture delivering the components to be tested.

15. The apparatus according to claim 12, wherein the components to be tested are semiconductor components that include integrated circuits, wafers of semiconductor material, or printed circuit boards.

16. The apparatus according to claim 12, wherein the first plug module has a plurality of contacts and the second plug module has a plurality of contacts that respectively engage the plurality of contacts of the first plug module to facilitate electrical connection between the test signal generator and the measurement card.

17. The apparatus according to claim 12, wherein the securing element is fixedly connected to the first plug module.

18. The apparatus according to claim 12, wherein the curvilinear groove formed in the securing element has a circumferential edge that is volute with respect to a circumferential edge of the securing element.

19. The apparatus according to claim 12, wherein an electric motor rotates the securing element.

20. The apparatus according to claim 12, wherein the curvilinear groove of the securing element has an end-stop, the position of the end-stop coinciding with a complete connection state between the first plug module and the second plug module.

21. The apparatus according to claim 12, wherein the first plug module and the second plug module each have at least one rail, wherein a rail of the first plug module interconnects with a rail of the second plug module.

22. The apparatus according to claim 21, wherein the rails of the first plug module and the second plug module facilitate connection of the first plug module to the second plug module.

23. The apparatus according to claim 21, wherein the interconnected rails of the first plug module and the second plug module substantially prevent movement between the first plug module and the second plug module in a plane that is substantially parallel to the rotation axis.

24. A method for testing a semiconductor component, the method including the steps of:

delivering the semiconductor component to a measurement card by a handling fixture;

providing test signals from a test signal generator to the semiconductor component, a connection between a first plug module and a second plug module facilitating an electrical connection the test signal generator and the measurement card; and testing the semiconductor component by measuring, via the measurement card, an operation of the semiconductor component on the basis of the test signals, wherein on the basis of a type of semiconductor component, the measurement card is replaced by disconnecting the first plug module from the second plug module via a securing element that rotates about a rotation axis and that facilitates connection and disconnection between the first plug module and the second plug module upon rotation of the securing element, wherein rotation is applied using a lever coupled to the securing element at its center of rotation, the securing element having a curvilinear groove formed therein that is in a plane that is substantially perpendicular to the rotation axis, the curvilinear groove engaging with a mating part that is fixedly connected to the second plug module, and wherein the first plug module has a guide surface that guides a draw-in plate of the second plug module to and from a shaft stub of the first plug module, wherein the draw-in plate of the second plug module has a slot formed therein for engaging the shaft stub of the first plug module to facilitate connection and disconnection between the first plug module and the second plug module.

25. The method according to claim 24, wherein the testing process of the semiconductor component is a part of a manufacturing process of the semiconductor component.

* * * * *